US007685979B2

(12) United States Patent
Akasaka et al.

(10) Patent No.: US 7,685,979 B2
(45) Date of Patent: Mar. 30, 2010

(54) VARIABLE VALVE TIMING MECHANISM FOR INTERNAL COMBUSTION ENGINE

(75) Inventors: Yuuzou Akasaka, Yokohama (JP); Yusuke Takagi, Yokohama (JP)

(73) Assignee: Nissan Motor Co., Ltd., Yokohama (JP)

( * ) Notice: Subject to any disclaimer, the term of this patent is extended or adjusted under 35 U.S.C. 154(b) by 33 days.

(21) Appl. No.: 11/861,580

(22) Filed: Sep. 26, 2007

(65) Prior Publication Data

US 2008/0078341 A1 Apr. 3, 2008

(51) Int. Cl.
*F01L 1/34* (2006.01)

(52) U.S. Cl. ..... 123/90.16; 123/90.15

(58) Field of Classification Search ..... 123/90.15, 123/90.16

See application file for complete search history.

(56) References Cited

U.S. PATENT DOCUMENTS

| | | | |
|---|---|---|---|
| 6,019,076 | A | 2/2000 | Pierik et al. |
| 7,021,258 | B2 | 4/2006 | Nohara et al. |
| 2004/0031456 | A1 | 2/2004 | Nakamura et al. |
| 2005/0211204 | A1 | 9/2005 | Todo et al. |
| 2007/0163524 | A1 * | 7/2007 | Muraji et al. ..... 123/90.16 |

FOREIGN PATENT DOCUMENTS

| | | | |
|---|---|---|---|
| EP | 1653065 | A2 | 5/2006 |
| EP | 1717428 | A1 | 11/2006 |
| EP | 1826367 | A1 | 8/2007 |
| JP | H11-324625 | | 11/1999 |
| JP | 2005-226543 | | 8/2005 |

* cited by examiner

*Primary Examiner*—Zelalem Eshete
(74) *Attorney, Agent, or Firm*—Global IP Counselors, LLP

(57) ABSTRACT

A variable valve timing mechanism comprises a drive shaft including a rocker arm, a control shaft, a stopper, a first spring member and a second spring member. The rocker arm opens and closes at least one of an intake/exhaust valve in response to rotation of the drive shaft. The control shaft changes a position of the rocker arm to continuously change valve lift characteristics of the intake/exhaust valve in response to rotation of the control shaft by driving a control shaft actuator. The stopper regulates an operating range of rotation of the control shaft between upper and lower limits. The first and second spring members urge the control shaft towards the upper and lower limits, respectively. The first and second spring members return the control shaft to a balance position between the upper limit position and the lower limit position when the internal combustion engine stops.

3 Claims, 7 Drawing Sheets

VARIABLE VALVE TIMING MECHANISM FOR INTERNAL COMBUSTION ENGINE

CROSS-REFERENCE TO RELATED APPLICATIONS

This application claims priority to Japanese Patent Application Nos. 2006-270233, filed on Oct. 2, 2006 and 2007-185222, filed on Jul. 17, 2007. The entire disclosures of Japanese Patent Application Nos. 2006-270233 and 2007-185222 are hereby incorporated herein by reference.

BACKGROUND OF THE INVENTION

1. Field of the Invention

The present invention generally relates to a variable valve timing mechanism for an internal combustion engine. More specifically, the present invention relates to a variable valve timing mechanism in which appropriate lift characteristics are attained for engine start-up.

2. Background Information

Variable valve timing mechanisms are used in internal combustion engines for opening and closing an intake valve or an exhaust valve that is linked to a crankshaft of the internal combustion engine and for varying the lift characteristics of the intake valve or the exhaust valve according to the rotation of a control shaft.

One example of such a variable valve timing mechanism is disclosed in Japanese Laid-Open Patent Publication No. 2005-226543. In this publication, the variable valve timing mechanism is provided with a stopper mechanism for mechanically regulating the upper and lower limit positions of the allowed range of rotation of the control shaft. A target control value of the control shaft is set within a range that is smaller than the range of rotation allowed by the stopper mechanism. Basically, the stopper mechanism of Japanese Laid-Open Patent Publication No. 2005-226543 has a minimum operational-angle stopper, a maximum operational-angle stopper and a stopper pin. The minimum and maximum operational-angle stoppers extend along the axial direction of the control shaft from an actuator plate towards the control shaft. The minimum and maximum operational-angle stoppers are affixed to a cylinder head. The stopper pin that is fixed to the control shaft and extends along the radial direction of control shaft.

In view of the above, it will be apparent to those skilled in the art from this disclosure that there exists a need for an improved variable valve timing mechanism. This invention addresses this need in the art as well as other needs, which will become apparent to those skilled in the art from this disclosure.

SUMMARY OF THE INVENTION

It has been discovered that in the variable valve timing mechanism described in Japanese Laid-Open Patent Publication No. 2005-226543, in order to ensure the air volume when the engine starts, the rotation angle position of the control shaft is set to have a large lift amount and a large operating angle relative to the lift amount and the operating angle just before the engine stops (usually idling). However, electric power must be provided to the starter motor when the engine starts. Therefore, an insufficient amount of electric power is supplied to the electric motor that acts as the actuator of the variable valve timing mechanism, and the control shaft cannot be quickly moved to a rotation angle position appropriate for start-up. Therefore, the appropriate lift amount and an operating angle for start-up cannot be set during idling. The usable region will be limited to a small lift and operating angle, and the degree of improvement related to fuel consumption and other aspects of engine performance will decrease.

The above mentioned object can basically be attained by providing a variable valve timing mechanism that comprises a drive shaft including a rocker arm, a control shaft, a stopper, a first spring member and a second spring member. The drive shaft is arranged to open and close at least one of an intake/exhaust valve via the rocker arm in response to rotation of the drive shaft. The control shaft is operatively coupled to the rocker arm to change a position of the rocker arm to continuously change valve lift characteristics of the intake/exhaust valve in response to rotation of the control shaft by driving a control shaft actuator. The stopper is arranged relative to the control shaft to regulate an operating range of rotation of the control shaft between an upper limit and a lower limit. The first spring member is arranged to urge the control shaft with a first urging force towards the upper limit in a first rotational direction. The second spring member is arranged to urge the control shaft with a second urging force towards the lower limit in a second rotational direction. The first and second spring members and the control shaft are further arranged such that the first and second urging forces of the first and second spring members return the control shaft to a balance position between the upper limit position and the lower limit position when the internal combustion engine stops.

These and other objects, features, aspects and advantages of the present invention will become apparent to those skilled in the art from the following detailed description, which, taken in conjunction with the annexed drawings, discloses preferred embodiments of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Figure 1:
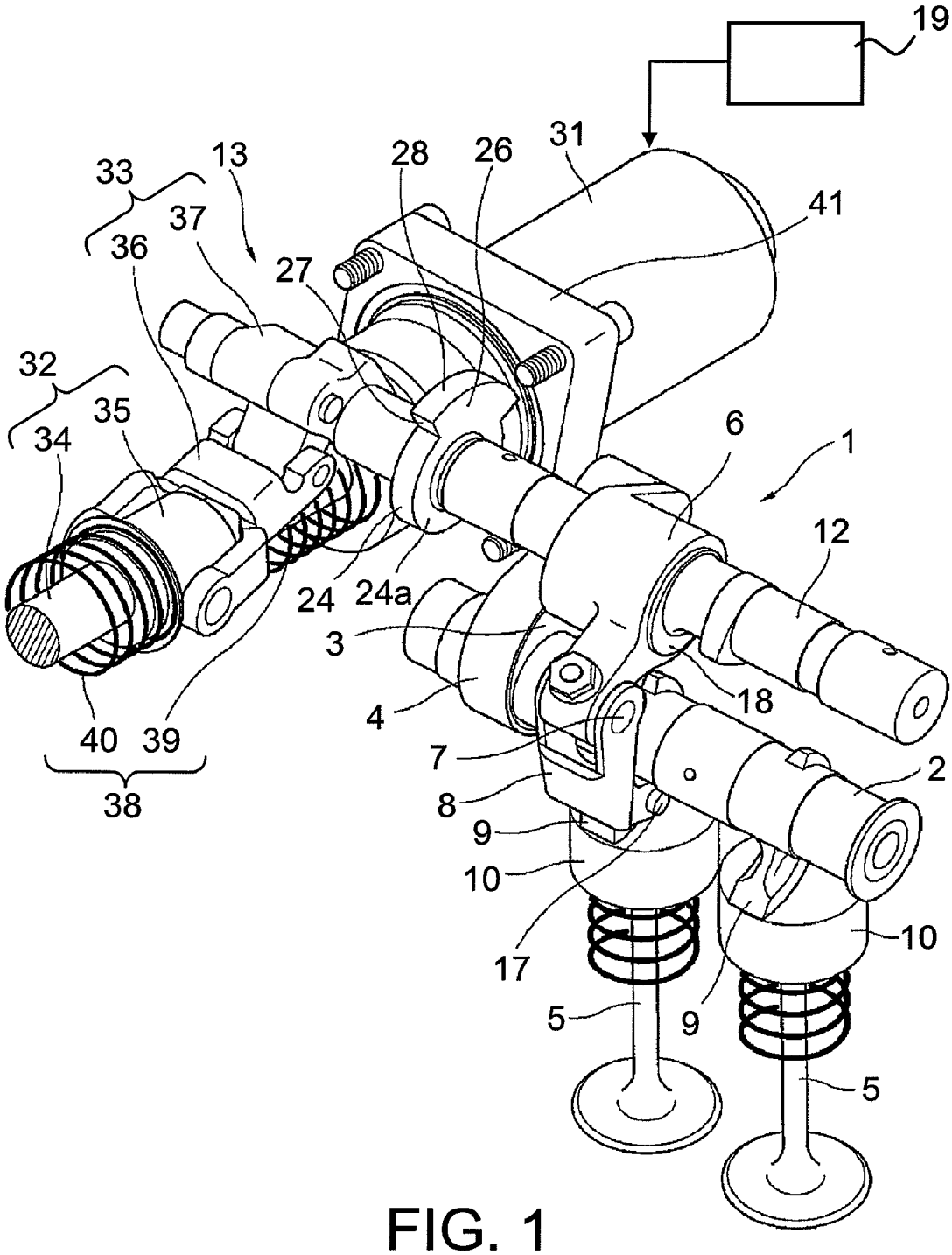
FIG. 1 is a simplified perspective view of a variable valve timing mechanism for an internal combustion engine, with the variable valve timing mechanism including an intermediate-position holding mechanism in accordance with a first embodiment.

Referring initially to FIG. 1, a simplified variable valve timing mechanism 1 is illustrated in accordance with a first embodiment of the present invention. The variable valve timing mechanism 1 is mechanically linked a crankshaft (not shown) so as to vary lift amount and operating angle of the valve timing. Thus, the variable valve timing mechanism 1 is configured to continuously change the lift characteristics, i.e., both the amount of valve lift and the operating angle, of the valve timing as explained below. As also explained below, the variable valve timing mechanism 1 is controlled to expand the variable range of lift characteristics of the valve timing such that an appropriate lift amount and an appropriate operating angle are obtained by the variable valve timing mechanism 1 when the internal combustion engine is stopped to ensure the ability of the internal combustion engine to be started, and to improve the fuel consumption of the internal combustion engine.

The variable valve timing mechanism 1 is rotatably supported by a cam bracket (only partially shown in FIG. 2) on the upper part of a cylinder head (not shown). The variable valve timing mechanism 1 controls the valve timing for opening and closing the intake ports and exhaust ports of an internal combustion engine (not shown). Typically, the internal combustion engine has a plurality of cylinders with one or two intake valves and one or two exhaust valves per cylinder. For the sake of simplicity, the variable valve timing mechanism 1 will only be discussed and illustrated relative to controlling the valve timing for opening and closing the intake ports of one cylinder. In the illustrated embodiment, the variable valve timing mechanism 1 is a well known apparatus. Thus, the variable valve timing mechanism 1 will only be briefly described and illustrated herein.

The variable valve timing mechanism 1 is provided with a drive shaft 2 having a plurality of eccentric drive-shaft parts 3 (only one shown) that are press-fitted or otherwise affixed to the drive shaft 2. Thus, these eccentric drive-shaft parts 3 rotate integrally with the drive shaft 2. The drive shaft 2 extends in the cylinder-row direction and supported above intake valves 5 by the cam bracket (not shown). An arm-shaped first linkage 4 is also provided on the drive shaft 2 at each of the eccentric drive-shaft parts 3. The first linkage 4 operatively connects the eccentric drive-shaft part 3 of the drive shaft 2 to one end of a rocker arm 6.

In particular, the first linkage 4 is linked to one end part of the rocker arm 6 via a linking pin (not shown), and a second linkage 8 is linked to the other end part of the rocker arm 6 via a linking pin 7. The second linkage 8 operatively links the other end part of the rocker arm 6 to an oscillating cam 9 that is oscillatably attached to the drive shaft 2. The oscillating cam 9 contacts an upper surface of a tappet (valve lifter) 10 to move an intake valve 5 according to the oscillation position of the oscillating cam 9. A pair of intake valves 5 is preferably provided in each cylinder of the engine.

The variable valve timing mechanism 1 is mechanically linked a crankshaft (not shown) for varying lift amount and operating angle to open and close the intake valves 5 (only two shown). Thus, the variable valve timing mechanism 1 is configured to continuously change the lift characteristics, i.e., both the amount of valve lift and the operating angle, of the intake valves 5 according to the rotation of a control shaft 12. The control shaft 12 is rotatably supported by the same cam bracket above the drive shaft 2. The control shaft 12 is positioned parallel to the drive shaft 2.

The second linkage 8 and the tip part of the oscillating cam 9 are linked by a linking pin 17. A base-circle surface that forms an arc concentric with the drive shaft 2, and a cam surface that extends from the base-circle surface and defines a prescribed curve, are formed continuously on the bottom surface of the oscillating cam 9. The base-circle surface and the cam surface face contact the upper surface of a tappet (valve lifter) 10 according to the oscillation position of the oscillating cam 9. Specifically, when the oscillating cam 9 oscillates, and the cam surface contacts the tappet 10, with the base-circle interval of the base-circle surface being such that the lift amount is 0, the intake valve 5 will be pressed down against the counter force of the valve spring and will slowly begin to lift.

An eccentric control shaft part 18 is press-fitted or otherwise affixed to the control shaft 12 so that the eccentric control shaft part 18 rotates integrally with the control shaft 12. The rocker arm 6 is oscillatably supported by the eccentric control shaft part 18 as an intermediate member.

The drive shaft 2 is driven by the crankshaft of the engine via a timing chain or a timing belt (not shown). Thus, the drive shaft 2 rotates around an axis in response to the rotation of the crankshaft. The eccentric drive-shaft part 3 has a circular outer circumferential surface whose center is offset by a prescribed amount from the axis of the drive shaft 2. The substantially central part of the rocker arm 6 is oscillatably supported by the eccentric control shaft part 18. The eccentric control shaft part 18 is offset by a prescribed amount from the axis of the control shaft 12. The center of oscillation of the rocker arm 6 therefore changes according to the angular position of the control shaft 12.

The control shaft 12 is configured to rotate within a prescribed range of rotational angles via a control shaft actuator 13 provided at one end of the control shaft 12. The control shaft actuator 13 can also be referred to as an electromotive device in the illustrated embodiment. The control shaft actuator 13 is controlled by a controlling device 19. The control shaft actuator 13 is energized by electricity to apply a driving torque to rotate the control shaft 12 to a desired position for the desired valve lift characteristics. One the control shaft actuator 13 is deenergized, the control shaft 12 can be freely moved to a balanced or rest position as explained below.

There follows a brief description of the operation of the variable valve timing mechanism 1. When the drive shaft 2 rotates, the oscillating cam 9 oscillates via the eccentric drive-shaft part 3, the first linkage 4, the rocker arm 6, and the second linkage 8. The tappet 10 is pressed down by the oscillating cam 9, and the intake valve 5 is opened and closed against the spring force of the valve spring. When the angular position of the control shaft 12 is changed by the control shaft actuator 13, the initial position of the rocker arm 6 changes, and the valve lift characteristics of the oscillating cam 9 will change continuously. In other words, both the lift amount and the operating angle can be continuously and simultaneously enlarged or constricted. The results depend on the layout of the various parts, but the opening and closing times of the intake valve 5 will change, e.g., substantially symmetrically with the increases and decreases of the lift amount and the operating angle.

The drive shaft 2 and the control shaft 12 that extend in the cylinder-row direction are shared by the plurality of cylinders that constitute the cylinder row, whereas the oscillating cam 9, the rocker arm 6, the first linkage 4, the second linkage 8, and other structural components of the variable valve timing mechanism 1 (mechanism for varying lift and operating angle) are provided independently to each of the cylinders that constitute the cylinder row.

Figure 2:
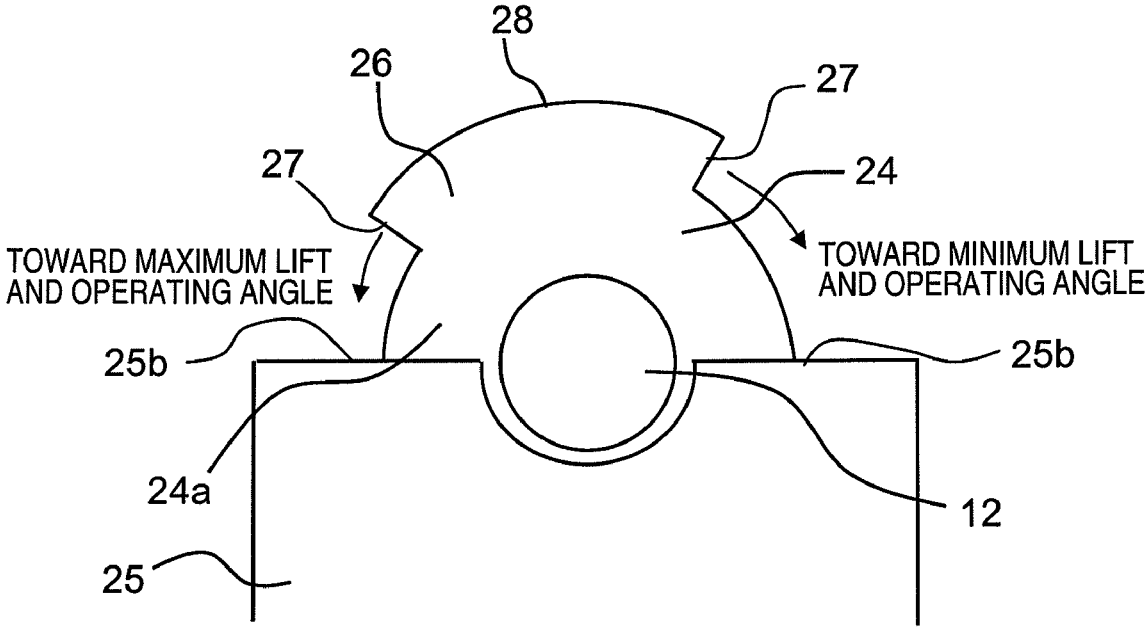
FIG. 2 is a simplified diagrammatic view of the stopper mechanism for the variable valve timing mechanism that mechanically stops the control shaft at the upper and lower limit positions of the allowed range of rotation of the control shaft in accordance with the first embodiment.

A flange part 24 is formed on the control shaft 12 of the variable valve timing mechanism 1. The flange part 24 acts as a flange-shaped rotating part on the control-shaft side. The flange part 24 protrudes from the outer circumferential surface of the control shaft 12, and regulates the movement of the control shaft 12 in the axial direction, as shown in FIGS. 1 and 2. The flange part 24 has a prescribed thickness along the axial direction of the control shaft 12 and is rotatably housed in a flange receiving part 25 of the cam bracket. Specifically, half of the flange part 24 is housed in the flange-receiving part 25, which acts as a control-shaft housing part on the side of the main body of the internal combustion engine. The movement of the control shaft 12 along the axial direction of the control shaft 12 is regulated by one of the axial end surfaces 24*a* of the flange part 24 contacting the flange receiving part 25.

A substantially arc-shaped stopper protruding strip 26 is formed on the outer circumference of the flange part 24, protrudes radially outward from the control shaft, and mechanically regulates the range of rotation of the control shaft 12. The stopper protruding strip 26 has the same thickness along the axial direction of the control shaft 12 as the flange part 24. The stopper protruding strip 26 is formed so as to contact a stopper protruding-strip receiving surface 25*b*, which is the upper surface of the flange receiving part 25, in concert with the rotation of the control shaft 12. In other words, the stopper protruding strip 26 and the stopper protruding-strip receiving surface 25*b* constitute a stopper mechanism for mechanically stopping or locking the control shaft 12 at the upper and lower limit positions of the allowed range of rotation of the control shaft 12. Specifically, the stopper protruding strip 26 comprises a pair of upright walls 27 and an outer circumferential wall 28 disposed between the upright walls 27. The upright walls 27 are perpendicular to the outer circumferential surface of the flange part 24. The upright walls 27 are capable of contacting the stopper protruding-strip receiving surface 25*b* in concert with the rotation of the control shaft 12. The outer circumferential wall 28 is an arc concentric with respect to the flange part 24 and connects the upper ends of the upright walls 27. Meanwhile, the stopper protruding-strip receiving surface 25*b* is formed so as to be aligned with a plane that passes through the axis of the control shaft 12 when the control shaft is mounted on the upper surface of the cam bracket. The mechanically allowed range of rotation of the control shaft 12 is regulated by one of the upright walls 27 of the stopper protruding strip 26 contacting the stopper protruding-strip receiving surface 25*b*.

However, the range of controlled rotation of the control shaft 12 is set to be smaller than the mechanically allowed range of rotation for obtaining an actual target control value. In other words, the smallest limiting position of the mechanically allowed range of rotation (where one of the upright walls 27 of the stopper protruding strip 26 collides with the stopper protruding-strip receiving surface 25*b*) is set with leeway so as to have a smaller lift and operating angle than the minimum value of the target control value of the control shaft 12. In the same way, the largest limiting position of the mechanically allowed range of rotation (where the other upright wall 27 of the stopper protruding strip 26 collides with the stopper protruding-strip receiving surface 25*b*) is set with leeway so as to have a larger lift and operating angle than the maximum value of the target control value of the control shaft 12.

Figure 3:
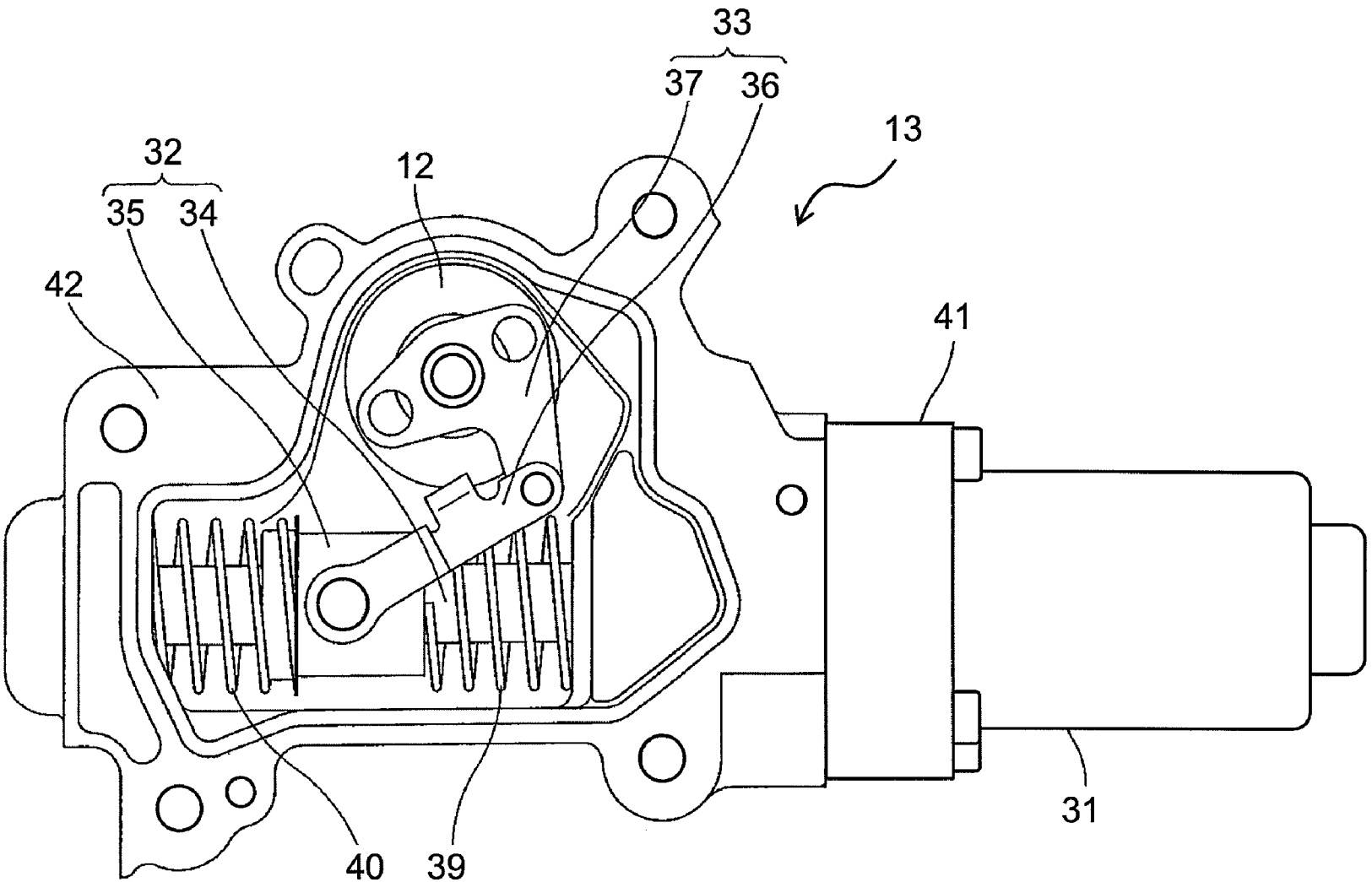
FIG. 3 is an elevational view of the control shaft actuator with the intermediate-position holding mechanism in accordance with the first embodiment.

The control shaft actuator 13 of the present embodiment includes an electric motor 31, a ball-screw mechanism 32 and a linking mechanism 33. The electric motor 31 acts as a drive source. The ball-screw mechanism 32 is linked to the electric motor 31 for operating the ball-screw mechanism 32. The linking mechanism 33 links the ball-screw mechanism 32 to the control shaft 12, as shown in FIGS. 1 and 3. The rotational force of the electric motor 31 is transmitted to the control shaft 12 via the ball-screw mechanism 32 and the linking mechanism 33.

Figure 4:
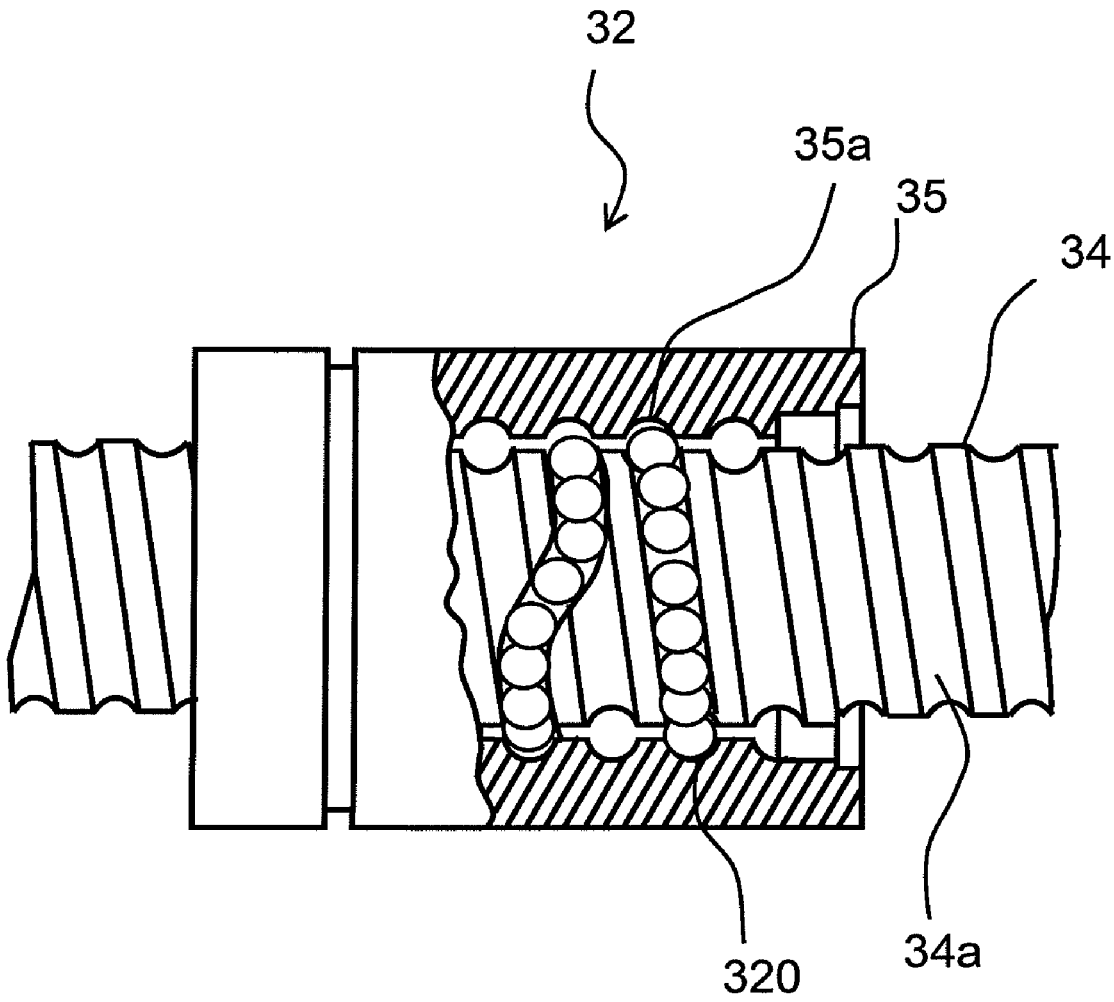
FIG. 4 is a descriptive diagram that schematically shows a ball screw mechanism of the variable valve timing mechanism of the internal combustion engine in accordance with the first embodiment.

The ball-screw mechanism 32 includes an elongated, cylindrical ball screw 34, a ball nut 35 and a plurality of balls 320. The ball screw 34 has a screw groove 34*a* formed on the outer circumferential surface, which is rotationally driven by the electric motor 31. The ball nut 35 has a screw groove 35*a* formed on the inner circumferential surface facing the screw groove 34*a*. The balls 320 are positioned between the screw groove 34*a* of the ball screw 34 and the screw groove 35*a* of the ball nut 35, as shown in FIG. 4. The balls 320 roll due to the rotation of the ball screw 34, whereby the ball nut 35 moves backwards or forwards on the ball screw 34 in the axial direction of the ball screw without rotating itself.

The linking mechanism 33 includes a first oscillating linkage 36 and a substantially L-shaped second oscillating linkage 37. The first oscillating linkage 36 is linked to the ball nut 35. The substantially L-shaped second oscillating linkage 37 has one end linked to the first oscillating linkage 36 and the other end affixed to the control shaft 12. The linking mechanism 33 changes the back-and-forth (linear) movement of the ball nut 35 into rotational movement that causes the control shaft 12 to rotate.

An intermediate-position holding mechanism 38 is provided within the control shaft actuator 13. The intermediate-position holding mechanism 38 is capable of holding the control shaft 12 in an intermediate position between the largest limiting position and the smallest limiting position that are the upper limit position and the lower limit position, respectively, of the mechanically allowed range of rotation.

The intermediate-position holding mechanism 38 includes a first spring member 39 and a second spring member 40. The first spring member 39 is arranged to constantly urge a first axial end of the ball nut 35 in a first axial direction of the ball screw (the right end in FIG. 3) toward a second axial end in the axial direction of the ball screw (the left in FIG. 3. The second spring member 40 is arranged to constantly urge the second axial end of the ball nut 35 in the second axial direction of the ball screw (the left end in FIG. 3) toward the first axial end in the axial direction of the ball screw (the right in FIG. 3). In other words, the springs 39 and 40 urge the ball nut 35 in opposite directions (directions opposite 180°) and constitute the intermediate-position holding mechanism 38.

In the variable valve timing mechanism 1 of the present embodiment, when the internal combustion engine stops, the driving torque of the electric motor 31 is no longer applied to the ball screw 34, the ball nut 35 is held in the balanced or rest position in which the urging force of the first spring member 39 and the urging force of the second spring member 40 are balanced. In other words, the control shaft 12 is held in the intermediate position (a position between the largest limiting position and the smallest limiting position of the mechanically allowed range of rotation of the control shaft 12) due to the ball nut 35 being held in the balanced position.

The first and second spring members 39 and 40 are both set so that the setting load is larger than the load necessary for the movement of the ball nut 35 when the control shaft 12 is changed from the upper limit position to the lower limit position of the allowed range of rotation of the control shaft.

The first and second spring members 39 and 40 are set so that the rotation angle position of the control shaft 12 when the ball nut 35 is in the balanced position has a lower lift and operating angle than the center of the usable range of operating angles of the intake valve 5 according to the variable valve timing mechanism 1. In other words, the lift characteristics of the variable valve timing mechanism 1 when the ball nut 35 is in the balanced position are set so that the lift and operating angle are smaller than the center of the range of usable operating angles of the intake valve 5.

When the ball nut 35 of the variable valve timing mechanism 1 of the present embodiment moves on the ball screw 34 toward the right in FIG. 3, the lift characteristics of the intake valve 5 change toward a relatively small lift and operating angle. When the ball nut 35 moves on the ball screw 34 toward the left in FIG. 3, the lift characteristics of the intake valve 5 change toward a relatively large lift and operating angle.

As seen in FIGS. 1 and 3, the control shaft actuator 13 has a securing flange 41 that is bolted to a housing 42 (FIG. 3) of the control shaft actuator 13.

As described above, when the internal combustion engine stops, the driving torque of the electric motor 31 is no longer applied to the ball screw 34, the ball nut 35 is held in the balanced position by the intermediate-position holding mechanism 38. Also the intermediate-position holding mechanism 38 of the above mentioned embodiment is capable of holding the rotation angle position of the control shaft 12 in an intermediate position between the smallest limiting position and the largest limiting position of the mechanically allowed range of rotation of the control shaft 12. Therefore, if the held rotation angle position of the control shaft 12 is set to a lift amount and an operating angle that are appropriate for start-up, the rotation angle position of the control shaft 12 during idling need not be set at the start-up of the internal combustion since it has already been taken into account. The rotation angle position of the control shaft 12 can be set to a smaller lift amount and a smaller operating angle. The range of controlled rotation of the control shaft 12 can therefore be expanded in a relative manner toward a smaller lift and a smaller operating angle. Thus, the ability of the internal combustion engine to be started can be ensured, and the fuel consumption of the internal combustion engine can be improved.

The ball nut 35 is constructed to be urged by both the first and second spring members 39 and 40. Therefore rattling due to the unavoidable clearance of the ball-screw mechanism 32 can be prevented.

Part of the external force that is transmitted from the control shaft 12 to the ball nut 35 via the linking mechanism 33 can be supported by the urging forces of the first and second spring members 39 and 40 that are constantly acting on the ball nut 35. Therefore, when the ball nut 35 is held in a prescribed position for a target lift amount and target operating angle, the holding torque necessary for the electric motor 31 can be made relatively small, and the electric power usage of the electric motor 31 can be lessened.

The first and second spring members 39 and 40 are both set so that the setting load is larger than the load necessary for the movement of the ball nut 35 when the control shaft 12 is changed from the upper limit position to the lower limit position of the allowed range of rotation of the control shaft. Therefore, the holding force increases when the position of the ball nut 35 is held at that location, fluctuations in the lift and central angle of the intake valve 5 due to the load input from the intake valves 5 can be minimized, the load on the ball nut 35 from the first and second spring members 39 and 40 can be reduced when the ball nut 35 is moved on the ball screw 34 in concert with changes in the target lift amount and target operating angle of the variable valve timing mechanism 1, and the responsiveness of the variable valve timing mechanism 1 can be improved.

The lift characteristics of the variable valve timing mechanism 1 in the balanced position are set so that the lift amount and the operating angle are less than the center of the range of usable operating angles of the intake valve 5. The loss of torque from the electric motor 31 due to the friction of the first and second spring members 39 and 40 can therefore be reduced due to the fact that the normal range of the lift characteristics used by the variable valve timing mechanism 1 is usually within a region of a relatively small lift and operating angle. The lift characteristics of the variable valve timing mechanism 1 in the balanced position can be set in a center of the usable range of operating angles of the intake valve 5, but can also be set so that the lift and operating angle are greater than the center of the usable range of operating angles of the intake valve 5.

In the variable valve timing mechanism 1 described above, when the lift characteristics are changed to a relatively small lift and operating angle, i.e., when the ball nut 35 is made to move towards the right in FIG. 3, the load (reaction forces of the valve spring and other parts of the intake valve 5) input from the intake valve 5 to the variable valve timing mechanism 1 acts in a direction that supplements the movement of the ball nut 35. On the other hand, when the lift characteristics are changed to a relatively large lift and operating angle, i.e., when the ball nut 35 is made to move towards the left in FIG. 3, the load (reaction forces of the valve spring and other parts of the intake valve 5) input from the intake valve 5 to the variable valve timing mechanism 1 acts in a direction that hampers the movement of the ball nut 35. Responsiveness can accordingly be improved when the lift characteristics are changed to a relatively large lift and operating angle in the embodiment described above if the spring constant of the second spring member 40, which is compressed when the lift characteristics are changed to a relatively large lift and operating angle, is set so as to be smaller than the spring constant of the first spring member 39.

Figure 5:
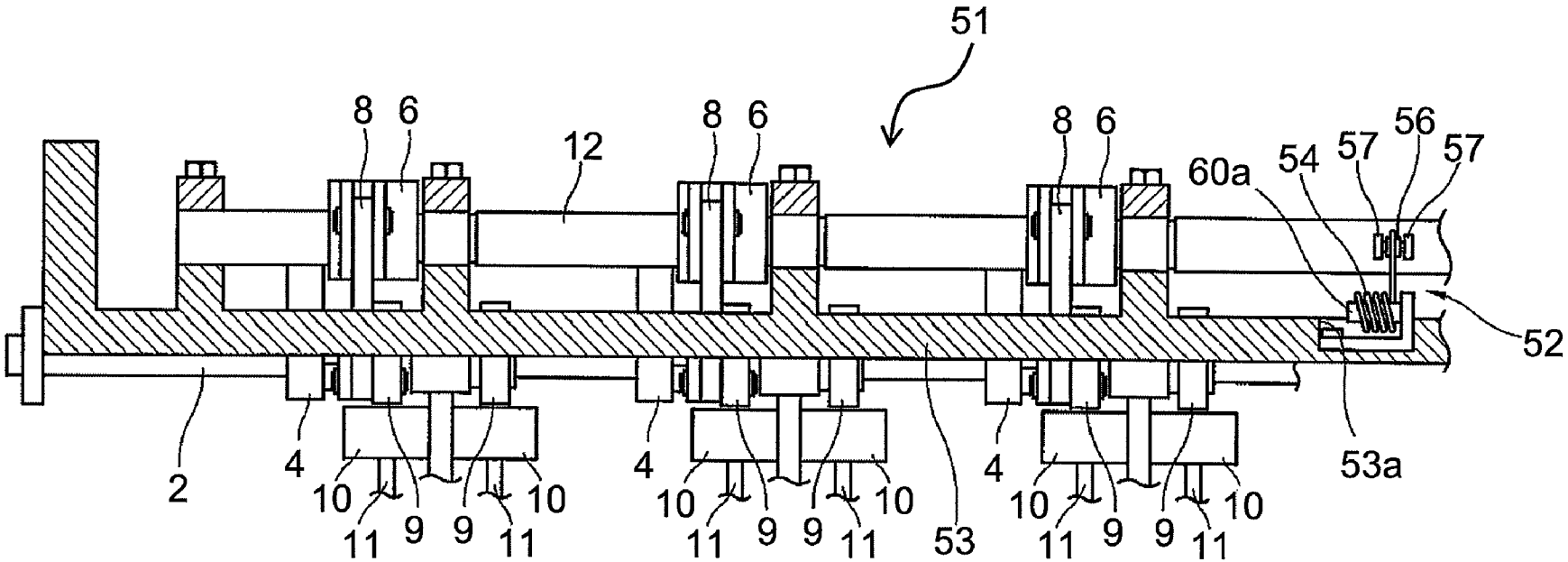
FIG. 5 is a simplified diagrammatic view of a portion of a variable valve timing mechanism including an intermediate-position holding mechanism in accordance with a second embodiment.
Figure 6:
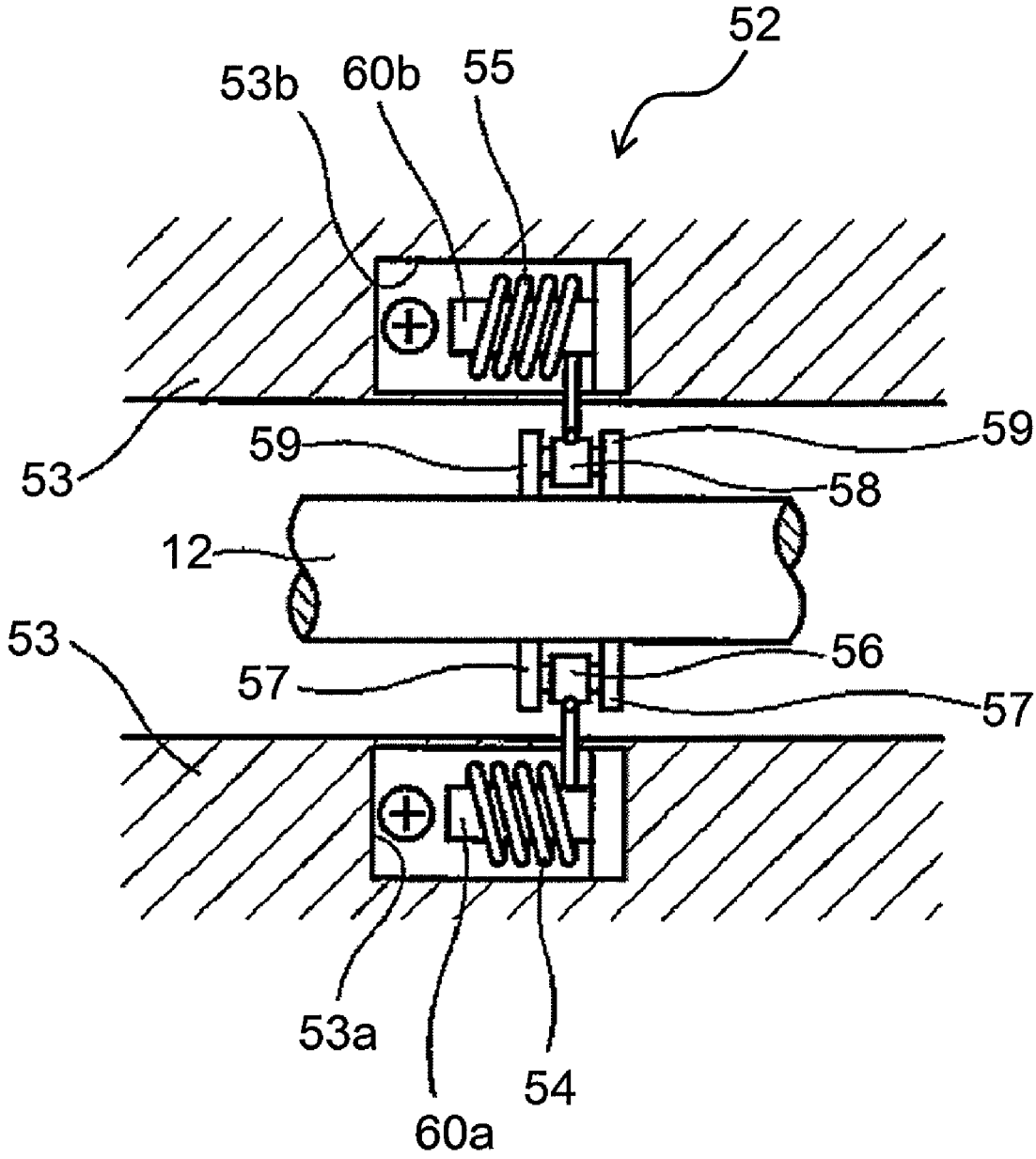
FIG. 6 is an enlarged simplified diagrammatic view of the intermediate-position holding mechanism of in accordance with the second embodiment.

Referring now to FIGS. 5 and 6, a variable valve timing mechanism 51 in accordance with a second embodiment will now be explained. In view of the similarity between the first and second embodiments, the parts of the second embodiment that are identical to the parts of the first embodiment will be given the same reference numerals as the parts of the first embodiment. Moreover, the descriptions of the parts of the second embodiment that are identical to the parts of the first embodiment may be omitted for the sake of brevity.

Basically, the variable valve timing mechanism 51 of the second embodiment has substantially the same configuration as the variable valve timing mechanism 1 of the above mentioned first embodiment. However, in the second embodiment, an intermediate-position holding mechanism 52 is positioned between the control shaft 12 and a cam bracket 53 on the upper part of the cylinder head. Thus, the intermediate-position holding mechanism 52 of the second embodiment is not provided within the housing of the control shaft actuator (not shown in FIGS. 5 and 6). Similar to the prior embodiment, the intermediate-position holding mechanism 52 changes the rotation angle position of the control shaft 12 when the engine is stopped. Specifically, the intermediate-position holding mechanism 52 of the second embodiment has a first spring member 54 and a second spring member 55. The first spring member 54 directly urges the control shaft 12 in a first rotational direction toward the upper limit position of the allowed range of rotation of the control shaft 12. The second spring member 55 directly urges the control shaft 12 in a second rotational direction toward the lower limit position of the allowed range of rotation of the control shaft 12. In other words, the direction urged by the first spring member 54 and the direction urged by the second spring member 55 are mutually opposite rotational directions of the control shaft 12. The first spring member 54 and the second spring member 55 are coil springs in the second embodiment. The axial directions of the first spring member 54 and the second spring member 55 are the same as the axial direction of the control shaft 12.

One end of the first spring member 54 has a first roller 56 affixed thereto. The other end of the first spring member 54 is affixed to a pillar part 60*a* that is fixed within a concave part 53*a* of the cam bracket 53. The first roller 56 is positioned on the outer circumference of the control shaft 12. The first roller 56 is positioned between a pair of first protruding walls 57 that protrude from the outer circumferential surface of the control shaft 12. The first roller 56 is rotatably supported by the first protruding walls 57. The pillar part 60*a* includes a substantially cylindrical protruding rod that extends parallel to the axial direction of the control shaft 12. The first spring member 54 has a coiled part that is externally disposed around the rod of the pillar part 60*a*.

One end of the second spring member 55 has a second roller 58 affixed thereto. The other end of the second spring member 55 is affixed to a pillar part 60*b* that is fixed within a concave part 53*a* of the cam bracket 53. The second roller 58 is positioned on the outer circumference of the control shaft 12. The second roller 58 is positioned between a pair of second protruding walls 59 that protrude from the outer circumferential surface of the control shaft 12. The second roller 58 is rotatably supported by the second protruding walls 59. The pillar part 60*b* includes a substantially cylindrical protruding rod that extends parallel to the axial direction of the control shaft 12. The second spring member 55 has a coiled part that is externally disposed around the rod of the pillar part 60*b*.

The rotation axes of the first and second rollers 56 and 58 are parallel to the axis of rotation of the control shaft 12. The urging forces of the first and second spring members 54 and 55 are balanced, i.e., equal in opposite directions to hold the control shaft 12 in a balanced position.

In the variable valve timing mechanism 51 of the second embodiment, when the internal combustion engine stops, the driving torque of the control shaft actuator 13 (not shown in FIGS. 5 and 6) is no longer applied to the control shaft 12, and the control shaft 12 is held in the intermediate position by the urging forces of the first and second spring members 54 and 55. The intermediate-position holding mechanism 52 is set so that this balanced position is an intermediate position (a position between the largest limiting position and the smallest limiting position of the mechanically allowed range of rotation of the control shaft 12).

In the second embodiment as well as in the above mentioned first embodiment, the rotation angle position of the control shaft 12 can be held in the intermediate position between the smallest limiting position and the largest limiting position of the mechanically allowed range of rotation of the control shaft 12 when the internal combustion engine stops. Therefore, if the held rotation angle position of the control shaft 12 is set to a lift amount and an operating angle that are appropriate for start-up, then the rotation angle position of the control shaft 12 during idling need not be set during start-up of the internal combustion engine. The rotation angle position of the control shaft 12 can be set to a smaller lift and a smaller operating angle than when the rotation angle position of the control shaft 12 is at a center rotation angle position between largest limiting position and the smallest limiting position of the mechanically allowed range of rotation of the control shaft 12. The range of controlled rotation of the control shaft 12 can therefore be expanded in a relative manner toward a smaller lift and a smaller operating angle. In this way, the ability of the internal combustion engine to be started can be ensured, and the fuel consumption of the internal combustion engine can be improved.

The first and second spring members 54 and 55 are formed at the same position in the axial direction of the control shaft 12 in the second embodiment, but the first and second spring members 54 and 55 can also be positioned so as to be mutually offset in the axial direction of the control shaft 12. The control shaft 12 is configured to be urged directly by the first and second spring members 54 and 55 in the second embodiment. However, the spring members that directly urge the control shaft 12 are not limited to a single pair; e.g., the control shaft 12 can also be configured to be urged directly by two pairs of spring members.

Figure 7:
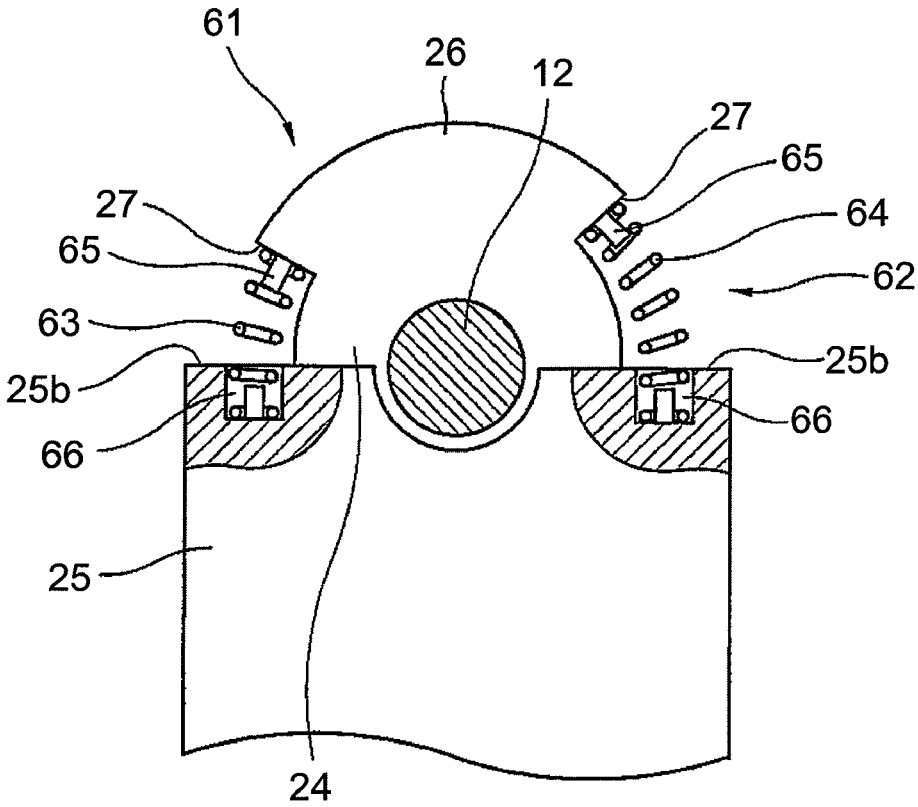
FIG. 7 is a simplified diagrammatic view of a stopper mechanism and an intermediate-position holding mechanism of in accordance with a third embodiment.
Figure 8:
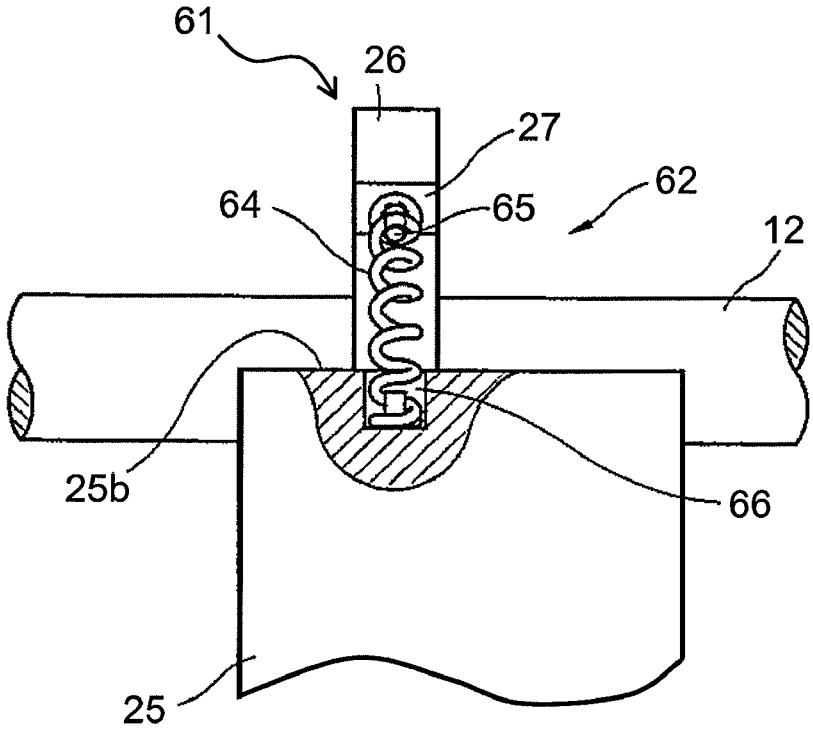
FIG. 8 is another simplified diagrammatic view of the stopper mechanism and the intermediate-position holding mechanism of in accordance with the third embodiment.

Referring now to FIGS. 7 and 8, a variable valve timing mechanism 61 is illustrated with an intermediate-position holding mechanism 62 in accordance with a third embodiment. In view of the similarity between the first and third embodiments, the parts of the third embodiment that are identical to the parts of the first embodiment will be given the same reference numerals as the parts of the first embodiment. Moreover, the descriptions of the parts of the third embodiment that are identical to the parts of the first embodiment may be omitted for the sake of brevity.

The variable valve timing mechanism 61 of the third embodiment has substantially the same configuration as the above mentioned first embodiment, but in the third embodiment, the intermediate-position holding mechanism 62 is positioned between the flange receiving part 25 of the cam bracket and the stopper protruding strip 26 of the flange part 24 provided to the control shaft 12, and is not provided within the control shaft actuator 13 (not shown in FIGS. 7 and 8) that changes the rotation angle position of the control shaft 12. Specifically, a first spring member 63 is sandwiched by one of the upright walls 27 of the stopper protruding strip 26 and a stopper protruding-strip receiving surface 25*b* of the flange receiving part 25, and a second spring member 64 is sandwiched by the other upright wall 27 of the stopper protruding strip 26 and a stopper protruding-strip receiving surface 25*b* of the flange receiving part 25.

In other words, the intermediate-position holding mechanism 62 of the third embodiment also comprises the first and second spring members 63 and 64. The first spring member 63 directly urges the control shaft 12 in a first rotational direction toward the upper limit position of the allowed range of rotation of the control shaft 12. The second spring member 64 directly urges the control shaft 12 in a second rotational direction toward the lower limit position of the allowed range of rotation of the control shaft 12. In other words, the rotational directions urged by the first and second spring members 63 and 64 are mutually opposite rotational directions of the control shaft 12.

A first end of each of the first and second spring members 63 and 64 is affixed to one of the upright walls 27 of the stopper protruding strip 26, and a second end of each of the first and second spring members 63 and 64 is affixed to a corresponding one of the stopper protruding-strip receiving surfaces 25*b*. Specifically, the stopper protruding strip 26 includes a pair of protruding parts 65 with one protruding from each of the upright walls 27. The protruding parts 65 are inserted into the first ends of the first and second spring members 63 and 64, which are coil springs. Thus, the first ends of the first and second spring members 63 and 64 are affixed to the upright walls 27 of the stopper protruding strip 26. Each of the stopper protruding-strip receiving surfaces 25*b* includes a concave part 66. These concave parts 66 receive the second ends of the first and second spring members 63 and 64. Thus, the second ends of the first and second spring members 63 and 64 are affixed to the concave parts 66 of the stopper protruding-strip receiving surfaces 25*b*. The urging forces of the first and second spring members 54 and 55 are balanced, i.e., equal in opposite directions, to hold the control shaft 12 in a balanced position (i.e., the intermediate position).

In the variable valve timing mechanism 61 of the third embodiment, when the internal combustion engine stops, the driving torque of the control shaft actuator 13 (not shown in FIGS. 7 and 8) is no longer applied to the control shaft 12, and the control shaft 12 is held in a balanced position in which the urging forces of the first and second spring members 63 and 64. The intermediate-position holding mechanism 62 is set so that this balanced or intermediate position that is a position between the largest limiting position and the smallest limiting position of the mechanically allowed range of rotation of the control shaft 12.

In the third embodiment as well as in the above mentioned first and second embodiments, the rotation angle position of the control shaft 12 can be held in the intermediate position between the smallest limiting position and the largest limiting position of the mechanically allowed range of rotation of the control shaft 12 when the internal combustion engine stops. Therefore, if the held rotation angle position of the control shaft 12 is set to a lift amount and an operating angle that are appropriate for start-up. Thus, the rotation angle position of the control shaft 12 during idling need not be set during the start-up of the internal combustion engine. The rotation angle position of the control shaft 12 can be set to a smaller lift amount and a smaller operating angle than the center rotation angle position of the control shaft 12. The range of controlled rotation of the control shaft 12 can therefore be expanded in a relative manner toward a smaller lift and a smaller operating angle, the ability of the internal combustion engine to be started can be ensured, and the fuel consumption of the internal combustion engine can be improved.

The variable valve timing mechanisms 1, 51 and 61 of the above mentioned embodiments was applied to intake valves, but this variable valve timing mechanism can also be applied to exhaust valves. Thus, the term "intake/exhaust valve" is used generically to include either an intake valve or an exhaust valve.

Now some of the operational effects of the above embodiments will be explained.

By using the intermediate-position holding mechanism 38, 52 and 62, if the held rotation angle position of the control shaft 12 is set to a lift amount and an operating angle that are appropriate for start-up, the rotation angle position of the control shaft for idling need not be set during start-up of the internal combustion engine. Also the rotation angle position of the control shaft 12 can be set to a smaller lift amount and a smaller operating angle than the center rotation angle position of the control shaft 12. The range of controlled rotation of the control shaft can therefore be expanded in a relative manner toward a smaller lift amount and a smaller operating angle. Thus, the ability of the internal combustion engine to be started can be ensured, and the fuel consumption of the internal combustion engine can be improved.

In addition, when the control shaft actuator 13 includes a ball-screw mechanism 32 that is linked to a drive source, rattling due to the mechanistically unavoidable clearance of the ball-screw mechanism 32 can thereby be prevented. Part of the external force that is transmitted from the control shaft 12 to the ball nut 35 via the linking mechanism 36 can be supported by the urging forces of the first spring member 39 and the second spring member 40 that are constantly acting on the ball nut 35. Therefore, when the ball nut 35 is held in a prescribed position for a target lift amount and target operating angle, the holding torque necessary for the electric motor can be made relatively small, and the electric power usage of the electric motor can be lessened.

Moreover, the first and second spring members 39 and 40 are both set so that a setting load is larger than the load necessary for the movement of the ball nut 35 when the control shaft 12 is changed from the upper limit position to the lower limit position of the allowed range of rotation of the control shaft 12. Therefore, the holding force increases when the position of the ball nut 35 is held at that location. Also fluctuations in the lift and central angle of the intake valves can be minimized. Furthermore, the load on the ball nut 35 from the first and second spring members 39 and 40 can be reduced when the ball nut 35 is moved on the ball screw 34 in concert with changes in the target lift amount and target operating angle of the variable valve timing mechanism, and the responsiveness of the variable valve timing mechanism can be improved.

Also, when the balanced position is set so that, when the ball nut 35 is in the balanced position, the lift characteristics have a smaller lift and a smaller operating angle than the center of the usable range of operating angles of the engine valve. The loss of torque from the electric motor due to the friction of the first and second spring members 39 and 40 can thereby be reduced due to the fact that the normal range of lift characteristics used by the variable valve timing mechanism is usually within a region of relatively small lifts and operating angles.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. A variable valve timing mechanism comprising:

a drive shaft arranged to open and close at least one of an intake/exhaust valve via a rocker arm in response to rotation of the drive shaft;

a control shaft operatively coupled to the rocker arm to change a position of the rocker arm to continuously change valve lift characteristics of the intake/exhaust valve in response to rotation of the control shaft by driving a control shaft actuator, the control shaft actuator including a drive source, a ball-screw mechanism linked to the drive source, and a linking mechanism linking the ball-screw mechanism to the control shaft;

a stopper arranged relative to the control shaft to regulate an operating range of rotation of the control shaft between an upper limit and a lower limit;

a first spring member arranged to urge the control shaft with a first urging force towards the upper limit in a first rotational direction; and a second spring member arranged to urge the control shaft with a second urging force towards the lower limit in a second rotational direction, with the first and second spring members being disposed on the ball-screw mechanism, the first and second spring members and the control shaft being further arranged such that the first and second urging forces of the first and second spring members return the control shaft to a balance position between the upper limit position and the lower limit position when the internal combustion engine stops with the control shaft disposed on either side of the balance position, and the first spring member and the second spring member having spring characteristics such that the valve lift characteristics of the intake/exhaust valve have a smaller lift amount and a smaller operating angle when the control shaft is held in the balance position than when held at a center rotation angle position of the operating range of the control shaft.

2. The variable valve timing mechanism according to claim 1, wherein the ball-screw mechanism includes a ball screw rotationally driven by the drive source, a ball operatively arranged to roll in response to rotation of the ball screw, and a ball nut disposed on the ball screw to move in an axial direction of the ball screw due to rolling movement of the ball;

the linking mechanism converts axial movement of the ball nut into rotational movement of the control shaft;

the first spring member urges the ball nut toward a first axial end of the ball screw to rotate the control shaft to the upper limit via the linking mechanism; and the second spring member urges the ball nut toward a second axial end of the ball screw to rotate the control shaft to the lower limit via the linking mechanism.

3. The variable valve timing mechanism according to claim 1, wherein the control shaft actuator includes an electromotive device that is energized to apply a driving torque to rotate the control shaft; and the first and second spring members and the control shaft being further arranged such that the first and second urging forces of the first and second spring members return the control shaft to the balance position between the upper limit position and the lower limit position when the electromotive device stops being energized.

* * * * *